US005269063A

United States Patent [19]

Okada

[11] Patent Number: 5,269,063

[45] Date of Patent: Dec. 14, 1993

[54] STEP-SLIDE TYPE CUTTER KNIFE WITH AUTOMATIC LOCK MECHANISM

[75] Inventor: Shoji Okada, Sakai, Japan

[73] Assignee: Olfa Kabushiki Kaisha, Japan

[21] Appl. No.: 985,148

[22] Filed: Dec. 3, 1992

[30] Foreign Application Priority Data

Apr. 30, 1992 [JP] Japan ..... 4-111392

[51] Int. Cl.[5] ..... B26B 1/08

[52] U.S. Cl. ..... 30/162; 30/320; 30/335

[58] Field of Search ..... 30/335, 151, 162, 329, 30/337, 339, 320

[56] References Cited

U.S. PATENT DOCUMENTS 4,170,062 10/1979 Machida ..... 30/162
4,232,445 11/1980 Ito ..... 30/162
4,322,885 4/1982 Osada ..... 30/162

FOREIGN PATENT DOCUMENTS 0089303 9/1983 European Pat. Off. ..... 30/335
61-42522 12/1986 Japan .
220991 11/1987 Japan .
1522454 8/1978 United Kingdom ..... 30/335

*Primary Examiner*—Douglas D. Watts
*Assistant Examiner*—Hwei-Siu Payer
*Attorney, Agent, or Firm*—Wegner, Cantor, Mueller & Player

[57] ABSTRACT

A cutter knife for locking a slider by the engagement between a leaf spring member and an engaging notch of a cutter main body. The leaf spring member has a flat spring section; and a U-shaped locking section projecting therefrom at a right angle therewith. A pair of flat portions of the locking section engage the engaging surfaces of the engaging notch. Consequently, the slider is locked. The operating member moves with respect to a slider main body, thus pressing the locking section downward. As a result, the slider is unlocked.

10 Claims, 8 Drawing Sheets

STEP-SLIDE TYPE CUTTER KNIFE WITH AUTOMATIC LOCK MECHANISM

BACKGROUND OF THE INVENTION

1. Field of the Invention

The present invention relates to a step-slide type cutter knife with automatic lock mechanism and more particularly to the cutter knife having a mechanism for locking a slider, movably inserted into a slide groove of a cutter main body and connected with a cutter blade, when the cutter knife is in use.

2. Description of the Related Arts

A mechanism for locking the slider of the cutter knife, in which a part of a spring held by the slider engages engaging notches formed longitudinally in regular intervals in the wall formed on a side surface of a slide groove in the cutter main body, is disclosed in Japanese Utility Model Publication No 2-20991.

According to the cutter knife disclosed in this Publication, the slider comprises a slider main body; and an operating member movable with respect to the slider main body in the moving direction of the cutter blade. The slider main body holds the center of a V-shaped leaf spring or a torsion spring. The slider is locked when both free ends of the spring engage with engaging notches of the cutter main body. A release strip is disposed on the operating member between both free ends of the spring so that it can move with the operating member. The release strip disengages one of the free ends of the spring from the engaging notch when the operating member is moved forward or backward with respect to the slider main body.

In this construction, when the slider is operated, the operating member moves in the moving direction of the blade with respect to the slider main body. As a result, the forward free end of the spring disengages from the engaging notch, thus allowing the movement of the cutter blade. When an operator's hand is released from the slider, each free end engages the engaging notch. As a result, the slider is locked with the cutter main body.

The construction of the locking mechanism of this cutter knife has a disadvantage that force applied to the cutter blade acts on the spring as a bending load during the use thereof. Accordingly, when a great force is applied to the cutter blade, the spring is deformed, which may damage the locking mechanism. Therefore, it is difficult to apply the locking mechanism to a large cutter knife.

There is proposed in Japanese Utility Model Publication No. 61-42522 a cutter knife comprising a locking mechanism for preventing force from being applied from the cutter blade to the spring. According to the cutter knife, the slider comprises the slider main body and the operating member similarly to the above-described cutter knife. A second spring for normally keeping the operating member at an intermediate position of its movable range is provided separately from a locking spring which engages the engaging notch of the cutter main body. The operating member has a locking section for supporting the engaging portion of the locking spring from the direction opposite to the disengaging direction of the engaging portion so that the engaging portion does not disengage from the engaging notch when the operating member is at the intermediate position as a result of the release of the operator's hand from the slider. The operation direction of the slider is substantially perpendicular to the disengaging direction of the locking spring. Thus, in operating the slider, the locking section of the operating member moves away from the engaging portion of the locking spring and hence the engaging portion is capable of disengaging from the engaging notch. In this manner, the blade can be moved forward or backward in the slide groove.

According to this construction, the force applied from the blade to the slider during the use of the cutter knife is supported by the locking section . Therefore, the locking mechanism is capable of withstanding a great force on condition that the engaging portion of the locking spring is rigid. But it is necessary for the locking mechanism to have the second spring for regulating the position of the operating member when the operator's hand is released from the slider. Thus, the locking mechanism has a complicated construction.

SUMMARY OF THE INVENTION

It is an object of the present invention to provide a cutter knife comprising a mechanism, for locking a slider, having a simple construction and capable of withstanding a great force.

In accomplishing this and other objects of the present invention, there is provided a step-slide type cutter knife with automatic lock mechanism whose composition is as described below.

That is, the cutter knife comprises: a cutter blade; a cutter main body having a slide groove into which the blade is reciprocatively inserted; and a slider inserted into the slide groove together with the blade. The cutter main body has an engaging wall projecting inward from at least one side of the slide groove. The engaging wall has engaging notches formed at predetermined intervals in the moving direction of the blade and having engaging surfaces opposed to each other in the moving direction of the blade. The slider comprises a slider main body connected with the blade; an operating member held by the slider main body; and a leaf spring member held by the slider main body and removably engaging the engaging notch.

The leaf spring member comprises a flat spring section extending along the moving direction of the blade; and a U-shaped locking section comprising a pair of flat portions projecting from the spring section in a direction substantially perpendicular thereto and opposed to each other and a curved portion interposed between the pair of the flat portions. The spring section is held by the slider main body so that the locking section is removably fitted into the engaging notch as a result of the movement of the locking section in the direction perpendicular to the spring section. The operating member is movable between a locking position at which the pair of the flat portions of the locking section engage the engaging surfaces of one of the engaging notches, and an unlocking position at which the flat portions disengage from the engaging surfaces. In the locking position, the flat portions may contact the engaging surface so that the locking section is closely fitted into the engaging notch or the locking section may be capable of moving slightly in the engaging notch in the moving direction of the blade.

According to the above construction, the flat portions of the locking section of the leaf spring member disengage from the engaging surfaces of the engaging notch by positioning the operating member at the unlocking position. At this time, the slider is operatable in the moving direction of the blade even though the curved surface of the locking section remains in the engaging notch. As a result, the blade can be moved forward or backward in the slide groove with the spring section flexed and the curved surface of the locking section sliding along the surface of the engaging wall. When the locking section is positioned at the adjacent engaging notch, the spring section causes the curved surface of the locking section to be fitted into the engaging notch. Upon release of hand from the operating member, the flat portions of the locking section engage the engaging surfaces of the engaging notch. As a result, the slider is locked.

When the cutter is used in this state, the force applied to the blade is transmitted to the slider main body. Since the spring section is disposed substantially in parallel with the direction of the force applied to the blade, the force does not act as a bending force on the leaf spring member. Thus, this construction is capable of preventing the spring from being deformed or damaged even though a great force is generated during the use of the cutter. That is, the construction is simple and yet capable of withstanding a great force.

Preferably, the moving direction of the operating member substantially coincides with that of the blade; and the operating member comprises an inclined, e.g. V-shaped, surface for pressing the locking section of the leaf spring member when the operating member is at the unlocking position, thus disengaging the locking section from the engaging notch.

According to the above construction, when the operating member is moved forward or backward, the inclined surface moves together with the operating member. Consequently, the locking section is pressed by the inclined surface and the pair of the flat portions move away from the engaging surfaces of the engaging notch. As a result, the slider is unlocked. Upon release of hand from the operating member at the position at which the locking section corresponds to one of the engaging notch, the leaf spring member returns to the original condition, thus locking the slider. With the return of the leaf spring member to the original condition, the operating member automatically returns to its original position with respect to the slider main body. In this manner, the slider can be unlocked by only moving the operating member in the moving direction of the blade and locked by releasing hand from the operating member. In addition, the slider has a simple construction because it is unnecessary to provide the slider with a second spring for returning the operating member to the locking position.

The moving direction of the operating member may substantially coincide with a direction perpendicular to the surface of the blade; and the operating member may comprises an presser surface for pressing the locking section of the leaf spring member when the operating member is at the unlocking position, thus disengaging the locking section from the engaging notch.

According to the above construction, the locking section can be moved away from the engaging notch by pressing the operating member in a direction at a right angle with the blade. Thus, the slider can be unlocked. The blade can be moved forward or backward by pressing the operating member and moving the operating member in the moving direction of the blade. Upon release of hand from the operating member, the slider can be locked.

Preferably, the engaging wall is formed on both sides of the slide groove. According to above construction, the locking section of the leaf spring member removably engages the engaging notches formed on both sides of the slide groove. In this case, force generated during the use of the cutter can be distributed to two places. Therefore, the locking mechanism can withstand a greater force and preferably applied to a large cutter knife.

In order to allow the locking section of the leaf spring member to removably engage with respect to the engaging notch, preferably, the locking section of the leaf spring member is formed in an intermediate position of the spring section; and one end of the spring section or both ends thereof is (are) slidably held by the slider main body in the direction along the surface of the spring section. Instead, the locking section of the leaf spring member may be formed on one end of the spring section; and the other end of the spring section may be fixed to the slider main body.

Preferably, the leaf spring member is formed by bending a material so that the locking section of the leaf spring member is integral with the spring section thereof. Thus, the leaf spring member has a simple construction. Instead, the material of the locking section of the leaf spring member may be different from that of the spring section thereof. In this case, the spring section may be made of a metal plate and the locking section may consist of synthetic resin having a low friction coefficient so that the slider can be moved smoothly.

The spring section may be disposed along a plane substantially in parallel with the surface of the blade so that the locking section of the leaf spring member removably engages the engaging notch in the direction from the bottom of the slide groove. Instead, the spring section may be disposed along a plane substantially perpendicular to the surface of the blade so that the locking section of the leaf spring member removably engages the engaging notch in the width direction of the slide groove.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
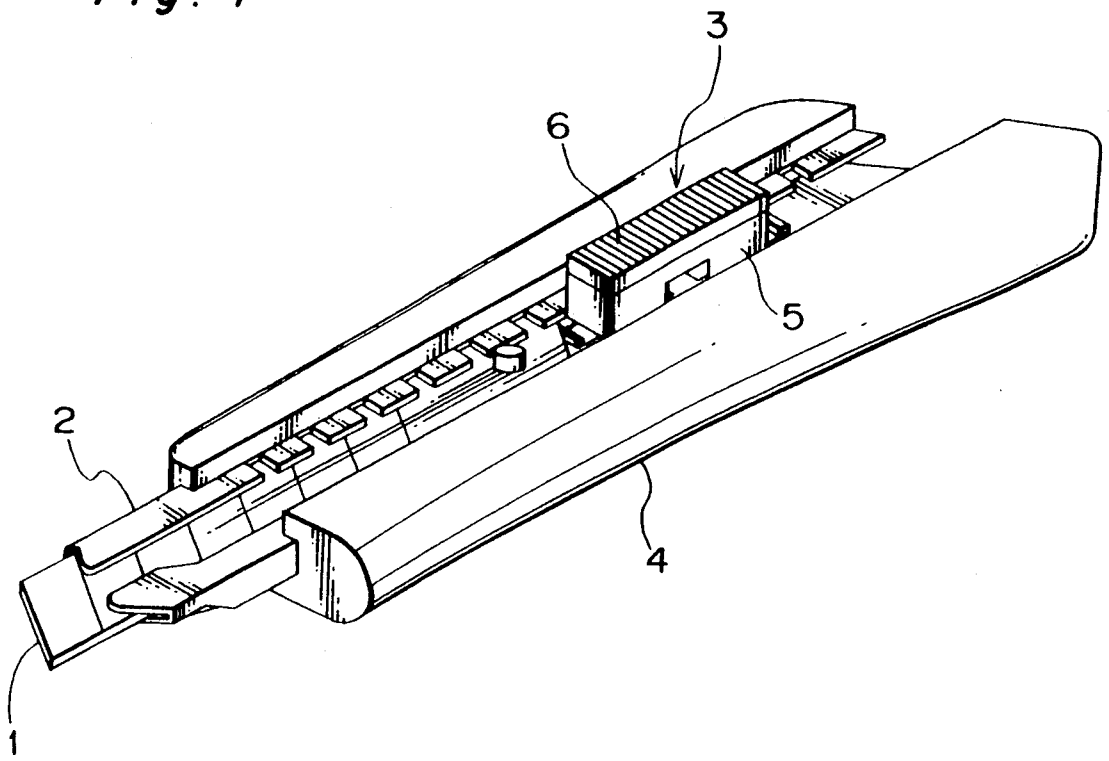
FIG. 1 is a perspective view showing a cutter knife according to a first embodiment of the present invention.
Figure 2:
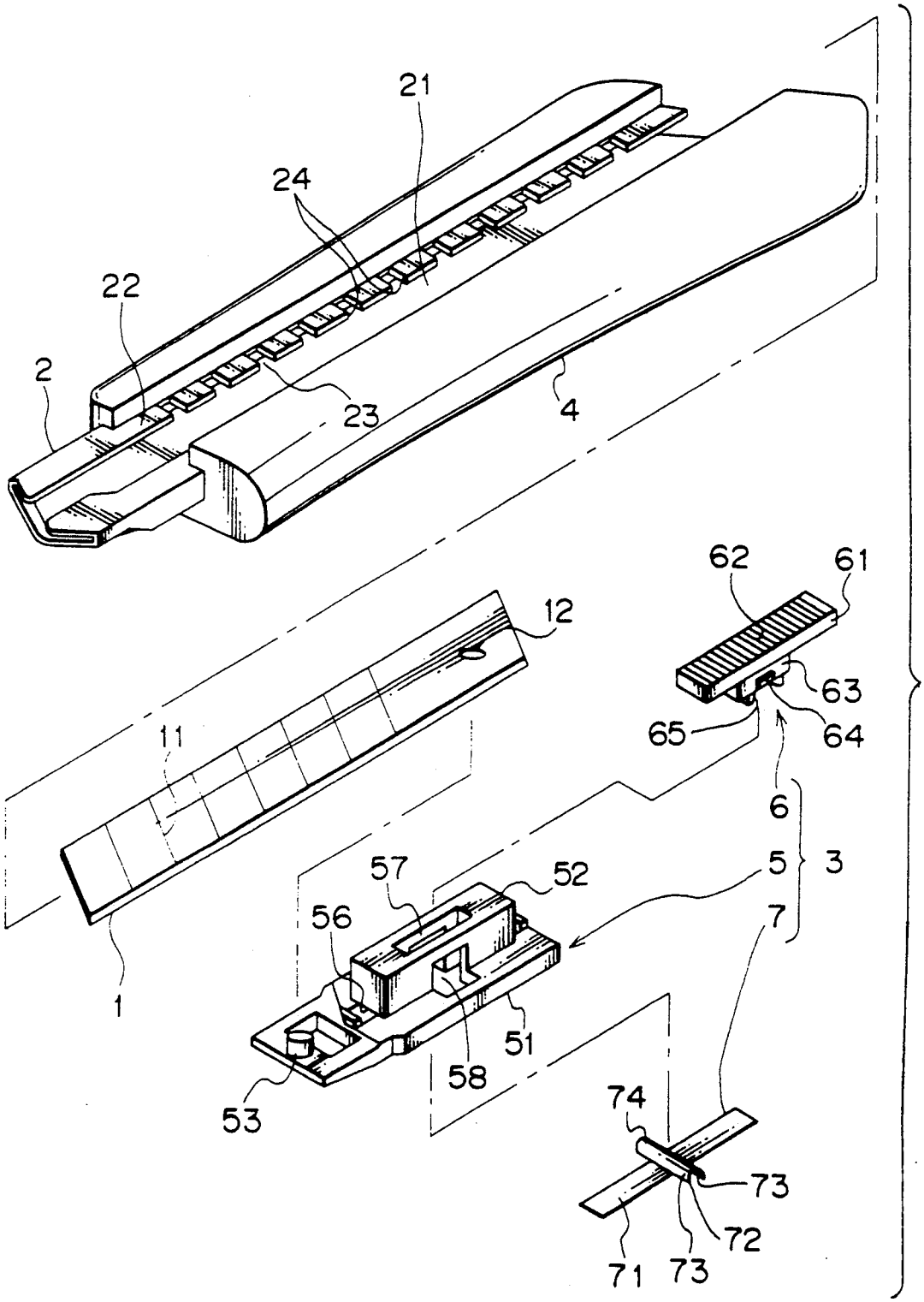
FIG. 2 is a perspective view showing the exploded cutter knife of FIG. 1.
Figure 3:
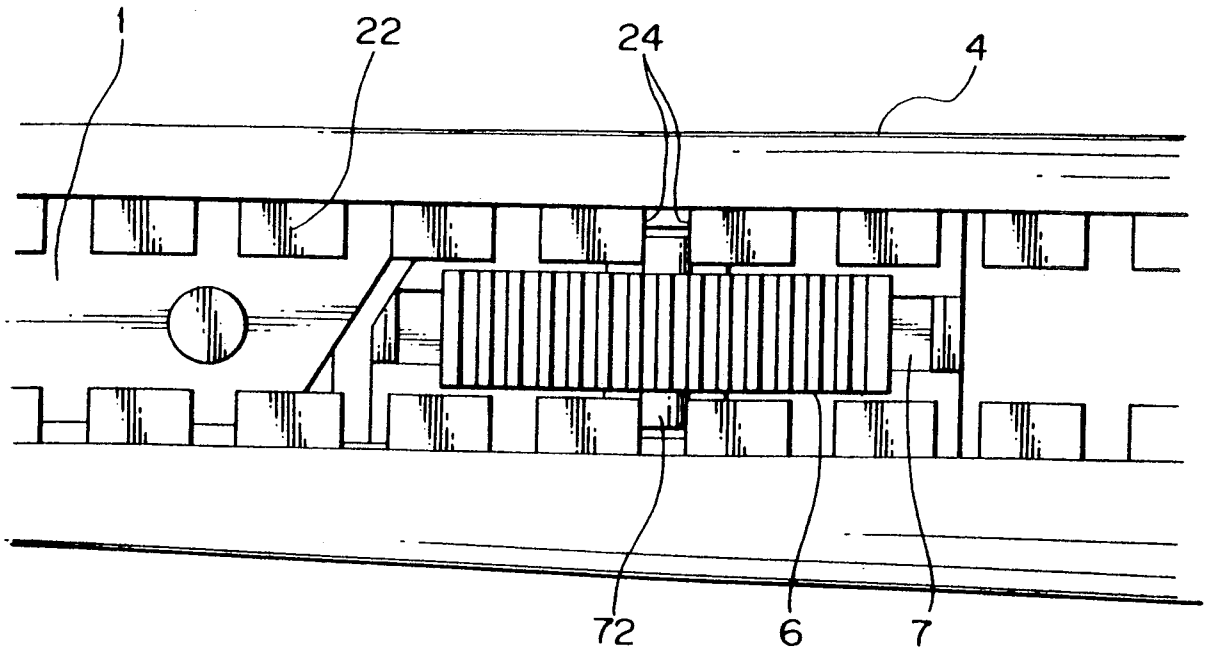
FIG. 3 is a plan view showing a locking mechanism of the cutter knife of FIG. 1.

Before the description of the present invention proceeds, it is to be noted that like parts are designated by like reference numerals throughout the accompanying drawings.

A step-slide type cutter knife with automatic lock mechanism according to a first embodiment of the present invention is described below with reference to FIGS. 1 through 4.

Referring to the above drawings, the cutter knife comprises a cutter blade 1 which can be snapped one by one along a notched line 11 when the blade 1 has been worn; a cutter main body 2 having a slide groove 21 into which the blade 1 is inserted linearly movably; and a slider 3 which is inserted into the slide groove 21 together with the blade 1.

The cutter main body 2 is formed by bending a metal plate into a configuration such as a lip channel steel. The cutter main body 2 has an engaging wall 22 projecting inward from both sides of the slide groove 21. Engaging notches 23 are formed in the engaging wall 22 at regular intervals in the moving direction of the blade 1. Each engaging notch 23 has engaging surfaces 24 opposed to each other in the moving direction of the blade 1. A grip 4 made of synthetic resin is fixed to the cutter main body 2 by means of insertion molding.

The slider 3 comprises a slider main body 5, an operating member 6, and a leaf spring member 7. The slider main body 5 comprises a base 51 inserted into the slide groove 21 of the cutter main body 2 and sandwiched between the bottom wall 25 (FIG. 4) of the slide groove 21 and the engaging wall 22; and a holding section 52, projecting from the base 51, for holding the operating member 6. The base 51 has a projection 53 formed at an end of the base 51 which is inserted into a connecting opening 12 formed at an end of the blade 1, so that the slider main body 5 and the blade 1 are coupled with each other in the slide groove 21. The leaf spring member 7 is held by the slider main body 5 so that it removably engages the engaging notch 23 of the engaging wall 22.

The leaf spring member 7 made of a bent metal plate comprises a narrow flat spring section 71 extending in the moving direction of the blade 1; and an inverted U-shaped locking section 72 wider than the spring section 71 and projecting vertically from the center of the spring section 71. The spring section 71 and the locking section 72 are integral with each other. The locking section 72 comprises a pair of flat portions 73 opposed to each other; and a curved portion 74 interposed between the pair of the flat portions 73. When the cutter is assembled, the boundaries between the flat portions 73 and the curved portion 74 is brought into contact with the engaging notch 23 of the engaging wall 22.

Figure 4:
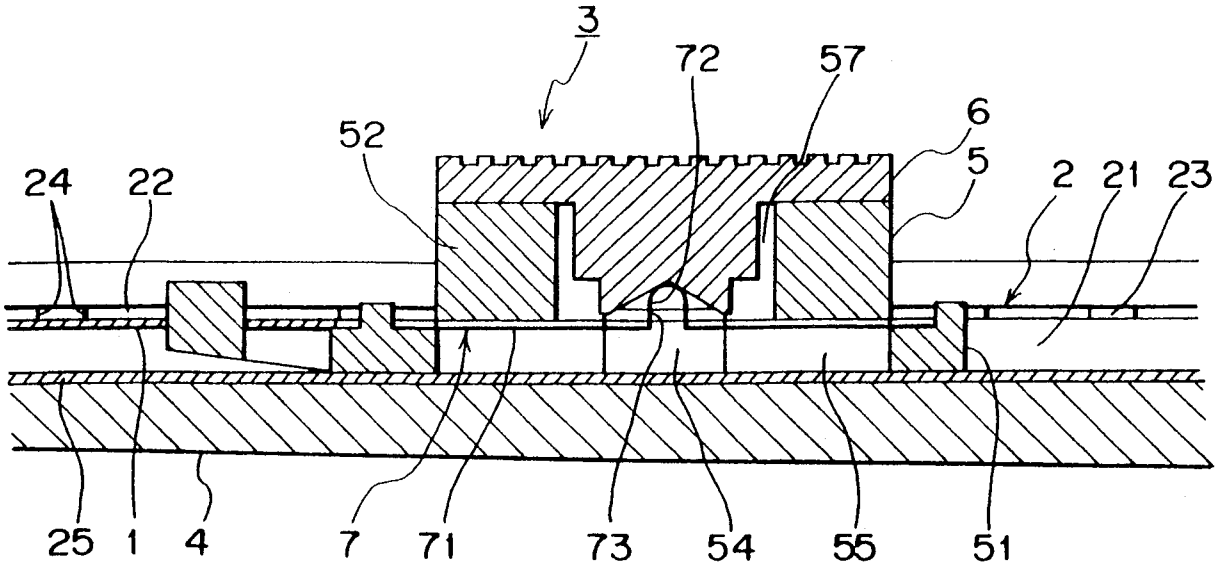
FIG. 4 is a sectional view showing the locking mechanism of the cutter knife of FIG. 1

Referring to FIG. 4 in particular, the base 51 of the slider main body 5 has a wide center opening 54 which receives the locking section 72 of the leaf spring member 7; and an opening 55 formed on both sides of the center opening 54 and being a little shorter than the total length of the spring section 71 of the leaf spring member 7. A slit 56 communicating with the opening 55 is formed between the holding section 52 and the base 51. The holding section 52 has an opening 57 in the center thereof and a groove 58 communicating with the opening 57 and formed on both sides thereof.

The operating member 6 comprises an operating section 61 having a plurality of slip-stopping knurls 62 formed on the upper surface thereof; and a locking portion 63 projecting downward from the bottom surface of the operating section 61 and inserted into the opening 57 of the holding section 52 of the slider main body 5. A claw 64 narrower than the groove 58 of the holding section 52 and engaging the groove 58 is formed on both sides of the locking portion 63 so that the operating member 6 mounted on the slider main body 5 can be slid in the moving direction of the blade 1. A V-shaped inclined surface 65 is formed at the lower end of the locking portion 63. The center of the inclined surface 65 is brought into contact with the curved portion 74 of the locking section 72 when the spring section 71 of the leaf spring member 7 which has been inserted into the slit 56 of the slider main body 5 is not flexed. When the operating member 6 is slid with respect to the slider main body 5, the inclined surface 65 presses the locking section 72 downward. As a result, the flat portion 73 disengages from the engaging surface 24, while the curved portion 74 remains in the engaging notch 23.

In the construction described above, when the leaf spring member 7 is not flexed, the operating member 6 is held at the locking position (the neutral position) as shown in FIG. 4. When the slider 3 and the blade 1 are positioned in the slide groove 21 of the cutter main body 2 at the locking position, the locking section 72 of the leaf spring member 7 is fitted into the notch 23 of the cutter main body 2 and the flat portions 73 substantially contact the engaging surfaces 24. When an external force by using the cutter is applied to the slider 3, the leaf spring member 7 is hardly deformed as compared with that of the conventional leaf springs because the leaf spring member 7 is disposed substantially in parallel with the external force-acting direction. Thus, this locking mechanism is capable of withstanding a great force even though the mechanism is applied to a large cutter. When a great force is applied to the locking section 72 of the leaf spring member 7, the locking section 72 moves away from the engaging notch 23 in a direction perpendicular to the engaging wall 22 because of the force applied from the engaging surface 24 to the curved portion 74. That is, the locking section 72 is automatically unlocked and thus fitted into the subsequent engaging notches 23. Therefore, the leaf spring member 7 is not damaged.

In moving the blade 1 forward or backward, the slider 3 is pressed by hand in the moving direction of the blade 1. As a result, the operating member 6 slides with respect to the slider main body 5 and the inclined surface 65 presses the locking section 72 of the leaf spring member 7 downward. Therefore, the flat portions 73 disengage downward from the engaging surfaces 24. While the slider 3 is kept pressed, the blade 1 can be moved with the spring section 71 flexed and the curved portion 74 contacting the lower surface of the engaging wall 22. When the locking section 72 has reached the adjacent notch 23, the flexure degree of the leaf spring member 7 decreases slightly. In pressing the slider 3 by hand until the blade 1 is at a desired position, the locking section 72 engages the engaging notches 23 and disengages therefrom repeatedly with clicks generated. Upon release of hand from the operating member 6 at the desired position, the locking section 72 of the leaf spring member 7 is fitted into the notch 23 of the cutter main body 2 and thus the flat portions 73 substantially contact the engaging surfaces 24. That is, the operating member 6 returns to the locking position. Thus, the blade 1 can be reliably locked as described above.

A cutter knife according to a second embodiment is described below with reference to FIG. 5.

The moving direction of the operating member 6a with respect to the slider main body 5 in the second embodiment is different from that in the first embodiment in that the operating member 6a also moves in a direction perpendicular to the surface of the blade 1. In the second embodiment, a locking portion 63a is vertically slidable along the inner walls 57a of the opening 57 of the slider main body 5. The locking portion 63a has a flat presser surface 65a formed at the lower end thereof. The presser surface 65a of the locking portion 63a contacts the locking section 72 of the leaf spring member 7 when the leaf spring member 7 is not flexed. A space is provided between the holding section 52 and the operating section 61a so that the locking section 72 is pressed by the presser surface 65a to the position at which the flat portions 73 of the locking section 72 disengage from the engaging surfaces 24 of the engaging notch 23.

Figure 5:
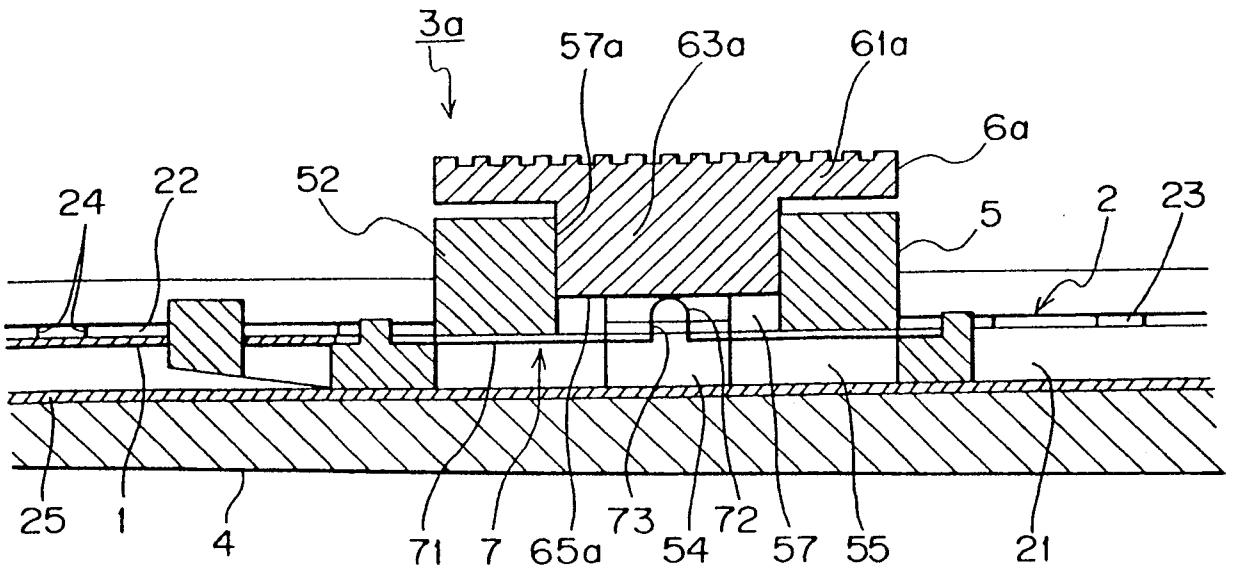
FIG. 5 is a sectional view showing a locking mechanism of a cutter knife according to a second embodiment of the present invention.

In the second embodiment, at the locking position as shown in FIG. 5, the leaf spring member 7 is hardly deformed by an external force applied to the slider 3 when the cutter is in use, similarly to the first embodiment. Therefore, the locking mechanism can be applied to a large cutter because it can withstand a great force applied to the blade 1. In moving the blade 1 forward or backward, the operating member 6a is pressed into the slider main body 5. As a result, the slider 3a is moved to a desired position with clicks being generated, similarly to the first embodiment.

Figure 6:
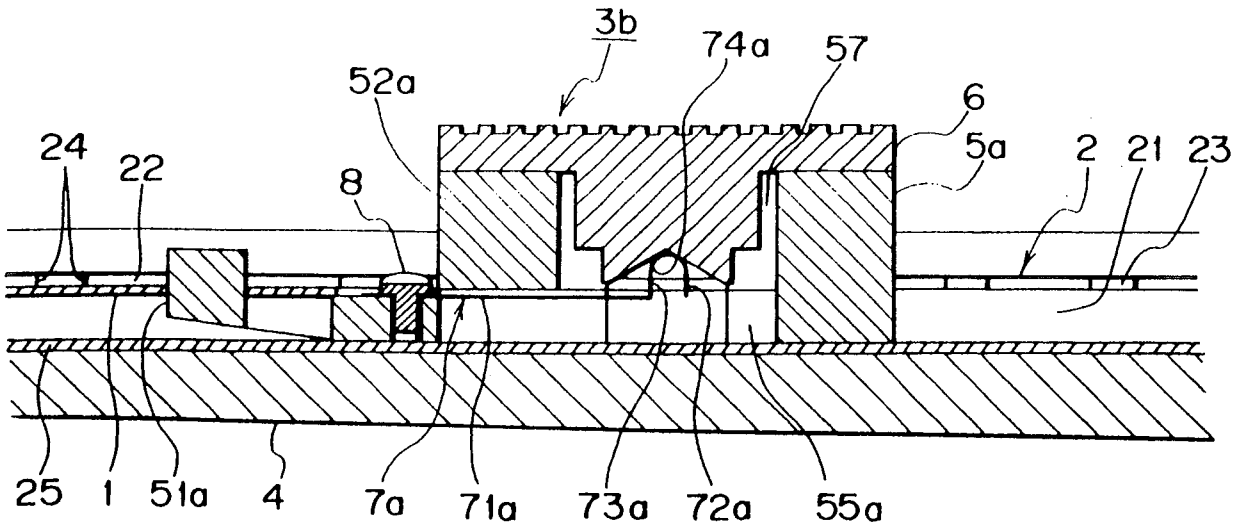
FIG. 6 is a sectional view showing a locking mechanism of a cutter knife according to a third embodiment of the present invention.

A cutter knife according to a third embodiment is described below with reference to FIG. 6. As described previously, in the first embodiment, the locking section 72 of the leaf spring member 7 is formed in the center of the spring section 71 and both ends of the spring section 71 are slidably held by the slider main body 5 while in the third embodiment, in the slider 3b, the locking section 72a of the leaf spring member 7a is formed at one end of the spring section 71a and the other end of the spring section 71a is fixed to the slider main body 5a by means of a screw 8. Since the method for holding the leaf spring member 7a according to the third embodiment is different from that of the first embodiment, the configuration of the base 51a and that of the opening 55a are different from that of the base 51 and that of the opening 55 of the first embodiment, respectively. In FIG. 6, reference numerals 52a, 73a and 74a, respectively, denote a holding section of the slider main body 5a, a pair of flat portions of the leaf spring member 7a and a curved portion of the locking section 72a.

Since this construction also prevents bending force from being applied to the leaf spring member 7a during the use of the cutter, the leaf spring member 7a can be prevented from being deformed even though a greater force is applied to the cutter. Thus, although the locking mechanism according to the third embodiment has a simple construction, it can be applied to a larger cutter.

Figure 7:
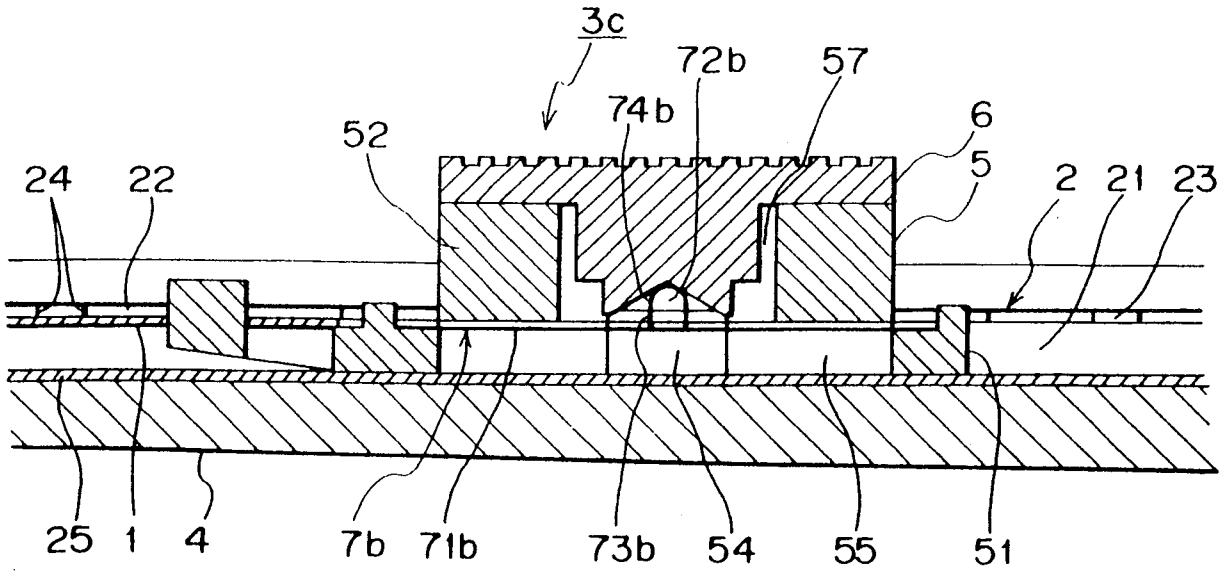
FIG. 7 is a sectional view showing a locking mechanism of a cutter knife according to a fourth embodiment of the present invention.

A cutter knife according to a fourth embodiment is described below with reference to FIG. 7. The construction of the locking mechanism according to the fourth embodiment is similar to that according to the first embodiment except that the material of the locking section 72b of the leaf spring member 7b is different from that of the spring section 71b thereof. Supposing that the locking section 72b is made of synthetic resin having a low friction coefficient, the slider 3c can be smoothly operated. In FIG. 7, reference numerals 73b and 74b, respectively, denote a pair of flat portions and a curved portion, both of which are formed on a surface of the locking section 72b.

As compared to the third embodiment, since the leaf spring members 7 and 7a of the first through third embodiments consist of a bent metal plate, they can be easily mass-produced by press working at a low cost. Further, even though the material of the spring sections 71 and 71a of the leaf spring members 7 and 7a are the same as that of the locking sections 72 and 72a thereof, the surface of the locking sections 72 and 72a may be coated with resin so as to smoothly operate the sliders 3, 3a, and 3b.

Figure 8:
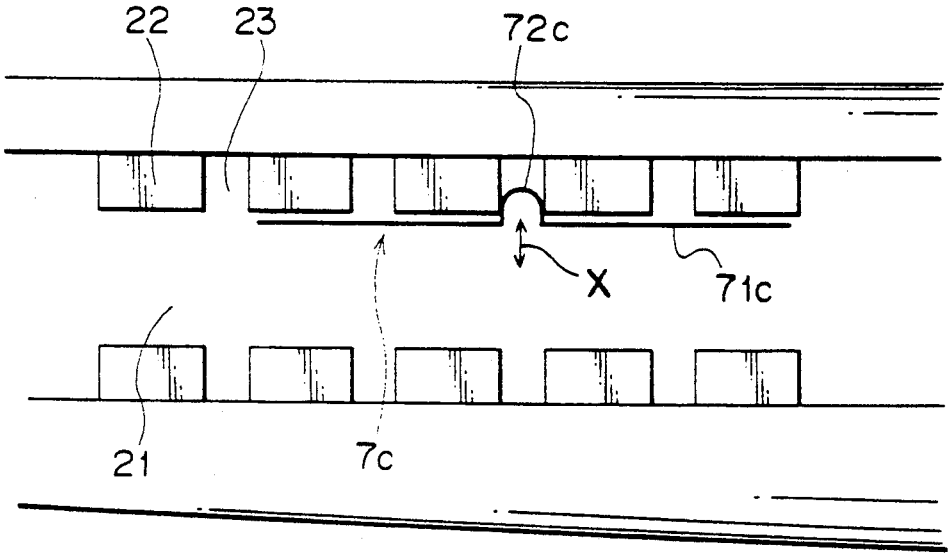
FIG. 8 is a plan view showing the engagement state between a leaf spring member and an engaging notch of a cutter knife according to a fifth embodiment of the present invention.

A cutter knife according to a fifth embodiment is described below with reference to FIG. 8 showing only the engagement between the engaging notch 23 and the leaf spring member 7c. In the fifth embodiment, the spring section 71c is disposed along a plane approximately perpendicular to the surface of the blade 1 so that the locking section 72c of the leaf spring member 7c removably engages the engaging notch 23 in the width direction of the slide groove 21. Accordingly, although not shown, the leaf spring member 7c is held by the slider main body with the leaf spring member 7c standing erect on the base of slider main body.

In the fifth embodiment, the locking section 72c moves in the direction as shown by an arrow X, thus removably engaging the engaging notch 23. In order to move the locking section 72c in this direction, it is necessary for the slider main body to hold the operating member of the slider so that the operating member is movable in the same direction. Otherwise, it is necessary to provide a slider main body to hold the operating member of the slider so that the operating member is movable in the moving direction of the blade or in a direction perpendicular to the surface of the blade, and in addition to provide a transmission means for moving the locking section 72c of the leaf spring member 7c in the direction indicated by an arrow X when the operating member is moved in the moving direction of the blade or the direction perpendicular to the surface of the blade. In this manner, the blade can be easily moved forward or backward, similarly to the first through fourth embodiment.

The cutter knife according to the present invention may be embodied in various aspects. For example, although the engaging notches 23 are formed on both sides of the slide groove 21, they may be formed only on one side thereof if the cutter is used to cut an object which can be cut with a small force. In this case, in the leaf spring members 7, 7a, and 7b, the locking sections 72, 72a, , and 72b are formed only on one side of the spring sections 71, 71a, and 71b, respectively. Further, the presser surface 65a of the locking portion 63a of the operating member 6a according to the second embodiment may be inclined.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A step-slide type cutter knife with automatic lock mechanism comprising: a cutter blade; a cutter main body having a slide groove into which the blade is reciprocatively inserted; and a slider inserted into the slide groove together with the blade, the cutter main body having an engaging wall projecting inward from at least one side of the slide groove; and the engaging wall having engaging notches formed at predetermined intervals in a moving direction of the blade and having engaging surfaces opposed to each other in the moving direction of the blade, the slider comprising a slider main body connected with the blade; an operating member held by the slider main body; and a leaf spring member held by the slider main body and movably engaging the engaging notches, wherein:

the leaf spring member comprises a flat spring section extending along the moving direction of the blade; and a U-shaped locking section comprising a pair of flat portions projecting from the spring section in a direction substantially perpendicular thereto and opposed to each other and a curved portion interposed between the pair of flat portions, and the spring section is held by the slider main body so that the locking section is movably fitted into the engaging notch as a result of the movement of the locking section in a direction perpendicular to the spring section, and the operating member is movable between a locking position at which the pair of the flat portions of the locking section engage the engaging surfaces of one of the engaging notches and an unlocking position at which the flat portions disengage from the engaging surfaces.

2. A cutter knife as defined in claim 1, wherein the moving direction of the operating member substantially coincides with that of the blade; and the operating member comprises an inclined surface for pressing the locking section of the leaf spring member when the operating member is at the unlocking position, thus disengaging the locking section from the engaging notch.

3. A cutter knife as defined in claim 1, wherein the moving direction of the operating member substantially coincides with a direction perpendicular to the surface of the blade; and the operating member comprises a presser surface for pressing the locking section of the leaf spring member when the operating member is at the unlocking position, thus disengaging the locking section from the engaging notch.

4. A cutter knife as defined in claim 1, wherein the engaging wall is formed on both sides of the slide groove.

5. A cutter knife as defined in claim 1, wherein the locking section of the leaf spring member is formed in an intermediate position of the spring section; and at least one end of the spring section is slidably held by the slider main body in the direction along the surface of the spring section.

6. A cutter knife as defined in claim 1, wherein the locking section of the leaf spring member is formed on one end of the spring section; and the other end of the spring section is fixed to the slider main body.

7. A cutter knife as defined in claim 1, wherein the leaf spring member is formed by bending a material so that the locking section of the leaf spring member is integral with the spring section thereof.

8. A cutter knife as defined in claim 1, wherein the material of the locking section of the leaf spring member is different from that of the spring section thereof.

9. A cutter knife as defined in claim 1, wherein the spring section is disposed along a plane substantially in parallel with the surface of the blade so that the locking section of the leaf spring member movably engages the engaging notch in the direction from the bottom of the slide groove.

10. A cutter knife as defined in claim 1, wherein the spring section is disposed along a plane substantially perpendicular to the surface of the blade so that the locking section of the leaf spring member movably engages the engaging notch in a width direction of the slide groove.

* * * * *